US007963640B2

(12) United States Patent
Tokunaga et al.

(10) Patent No.: US 7,963,640 B2
(45) Date of Patent: Jun. 21, 2011

(54) LIQUID DISCHARGE HEAD AND METHOD FOR MANUFACTURING THE LIQUID DISCHARGE HEAD

(75) Inventors: Hiroyuki Tokunaga, Fujisawa (JP); Koichiro Nakanishi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 967 days.

(21) Appl. No.: 11/845,467

(22) Filed: Aug. 27, 2007

(65) Prior Publication Data

US 2008/0062229 A1 Mar. 13, 2008

(30) Foreign Application Priority Data

Sep. 8, 2006 (JP) ..... 2006-244150

(51) Int. Cl.
*B41J 2/045* (2006.01)

(52) U.S. Cl. ..... 347/71

(58) Field of Classification Search ..... None
See application file for complete search history.

(56) References Cited

U.S. PATENT DOCUMENTS

| | | | | |
|---|---|---|---|---|
| 6,908,563 | B2 | 6/2005 | Tokunaga | |
| 7,207,109 | B2 | 4/2007 | Tokunaga et al. | |
| 7,448,733 | B2 * | 11/2008 | Murata et al. | 347/71 |
| 2005/0128255 | A1 | 6/2005 | Nakanishi | |
| 2006/0027529 | A1 | 2/2006 | Tokunaga | |
| 2006/0028513 | A1 | 2/2006 | Tokunaga | |

FOREIGN PATENT DOCUMENTS

| | | |
|---|---|---|
| JP | 9-277519 | 10/1997 |
| JP | 2000-37868 | 2/2000 |
| JP | 2004-186574 | 7/2004 |

* cited by examiner

*Primary Examiner* — Jerry T Rahll

(74) *Attorney, Agent, or Firm* — Fitzpatrick, Cella, Harper & Scinto

(57) ABSTRACT

A liquid discharge head according to the present invention comprises plural pressure chambers for applying pressure to liquid, which respectively communicate with liquid discharge openings for discharging liquid; and plural piezoelectric elements, arranged respectively corresponding to the plural pressure chambers, which respectively include lower electrodes, piezoelectric layers and upper electrodes layered in order from the pressure chambers, the lower electrodes being extended to areas corresponding to areas between the plural pressure chambers, and wherein an insulating layer is provided so as to cover at least all the lower electrodes located in the areas corresponding to areas between the plural pressure chambers.

6 Claims, 9 Drawing Sheets

LIQUID DISCHARGE HEAD AND METHOD FOR MANUFACTURING THE LIQUID DISCHARGE HEAD

BACKGROUND OF THE INVENTION

1. Field of the Invention

The present invention relates to a liquid discharge head for discharging a desired liquid by externally applying energy, and a method for manufacturing the liquid discharge head. The liquid discharge head of the invention can be applied to an ink jet recording head that prints on materials such as paper, cloth, leather, non-woven fabric and OHP sheets, a patterning device or a coating device that attaches a liquid to a solid object, such as a substrate or a plate member. A typical ink jet recording head will now be described.

2. Description of the Related Art

Printers using ink jet recording heads are widely employed for personal computers because they can provide satisfactory printing functions at low cost. Various types of ink jet recording heads have been developed, for example: heads that employ thermal energy to generate bubbles in ink, and use pressure waves produced by the bubbles to discharge ink droplets; heads that employ electrostatic force to attract and discharge ink droplets; and heads that employ pressure waves generated by vibrators, such as piezoelectric elements.

An ink jet recording head that employs a piezoelectric device includes: ink flow paths that communicate with ink discharge openings; and pressure generation chambers that communicate with the ink flow paths. Piezoelectric thin film is adhered to vibration plate film that is deposited on pressure generation chambers, and when a predetermined voltage is applied to the piezoelectric thin film, the film either stretches or contracts. As the piezoelectric thin film stretches or contracts, the vibration plate film vibrates with the piezoelectric thin film, generating a pressure pulse in ink held, under pressure, in the pressure generation chambers. As a result, ink is forced through the ink discharge openings and discharged as droplets.

As requests for higher definition images have increased, ink jet recording heads have become ever more highly integrated, i.e., multiple ink pressure generation chambers and multiple pressure generation sources, such as piezoelectric elements on flow path substrates, have been arranged at higher densities.

In order to better cope with these requests for higher definition images, an example piezoelectric type ink jet recording head is proposed wherein, using a film deposition technique, electrodes and piezoelectric members are formed across the entire surface of a vibration plate, and through the application of a photolithography technique, these electrodes and piezoelectric members are processed in correlation with the ink pressure chambers. In this case, a high density ink jet recording head is obtained by employing both the film deposition technique and the photolithography technique. Further, since an Si substrate and a metal member are respectively employed as a flow path substrate and as an orifice plate, flow paths and orifices can be accurately formed.

Generally, piezoelectric members are formed in correlation with the ink pressure chambers, and have smaller widths than have the ink pressure generation chambers. Furthermore, a dry etching technique using a chlorinated gas has recently been introduced for processing these piezoelectric members. And compared with wet etching, using a hydrofluoric acid solution or an oxidized solution, etching rates and etching shapes can more easily be controlled, enabling accurate processing.

As a method to improve the dielectric strength of a piezoelectric device, Japanese Patent Application Laid-Open No. 2004-186574 discusses a technique for laminating a Pb containing perovskite material and a Pb not containing perovskite material. Furthermore, Japanese Patent Application Laid-Open No. H09-277519 discusses a technique whereby a step shaped piezoelectric layer is formed to cover and protect lower electrodes.

Japanese Patent Application Laid-Open No. 2000-037868 discusses a technique whereby an inter-layer insulating layer is formed between an upper electrode and a lower electrode that are led outside from a piezoelectric device in order to prevent the destruction of a piezoelectric layer.

For an arrangement wherein a lower electrode is not patterned, the lower electrode is employed as an etching stop layer when processing a piezoelectric member using the dry etching method. When this arrangement is used to process a piezoelectric member, the lower electrode is also etched, although only slightly. On the contrary, however, especially when a Pt electrode is employed as a lower electrode and a chlorine gas used for this processing contacts the surface of the Pt electrode, considerable etching of the Pt electrode occurs.

Especially when a hard to etch material, such as lead zirconate titanate (PZT), is employed as a piezoelectric member, the process tends to be performed under an etching condition that there is a strong sputtering connotation. At such a time, when the lower electrode is exposed during the etching of the piezoelectric member, the material for the lower electrode may be sputtered and be attached to the end face of the processed piezoelectric member. The attachment of metal to the end face of the piezoelectric member could cause a short between the upper and lower electrodes and destroy the piezoelectric thin film.

Furthermore, when the lower electrode is exposed near piezoelectric thin film that serves as a driver, when the piezoelectric member is driven, a short may occur between the upper and lower electrodes, or the electrodes or the piezoelectric thin film may be damaged.

As another problem, since a piezoelectric member generally has a high dielectric constant, a piezoelectric device has a large electrostatic capacity and a low response speed relative to a drive wave, so that the timely capture and utilization of a drive wave that will provide an adequately accurate discharge is sometimes not possible. Further, since an electrostatic capacity is not required for electric leads to external wiring, a reduction in the electrostatic capacity is demanded.

SUMMARY OF THE INVENTION

To resolve the above described problems, one objective of the present invention is to provide a reliable liquid discharge head that both prevents damage to electrodes and piezoelectric members and shorts, between upper and lower electrodes, and provides rapid responses and accurate discharge control, and a method for manufacturing the liquid discharge head.

A liquid discharge head according to the present invention comprises: plural pressure chambers for applying pressure to liquid, which communicate with liquid discharge openings for discharging liquid respectively; and plural piezoelectric elements, arranged corresponding to the plural pressure chambers, respectively, which respectively include lower electrodes, piezoelectric layers and upper electrodes layered in order from the pressure chambers, the lower electrodes being extended to areas corresponding to areas between the plural pressure chambers, and wherein an insulating layer is provided so as to cover at least all the lower electrodes located in the areas corresponding to areas between the plural pressure chambers.

According to the present invention, for a liquid discharge head that includes: plural pressure chambers for applying pressure to liquid, which communicate with liquid discharge openings for discharging liquid respectively; and plural piezoelectric elements, arranged corresponding to the plural pressure chambers, respectively, which respectively include, lower electrodes, piezoelectric layers and upper electrodes layered in order from the pressure chambers, the lower electrodes being extended to areas corresponding to areas between the plural pressure chambers, a manufacturing method comprises the steps of: depositing an insulating layer on the lower electrode; forming a material layer, for the piezoelectric layer, on the insulating layer; and etching portions of the material layer, for the piezoelectric layer, to expose the insulating layer between the plural piezoelectric elements.

As described above, during a liquid discharge manufacturing process performed according to the present invention, impurities will not be attached to the side walls of piezoelectric members. Furthermore, voltage resistance will be improved between the upper and lower electrodes and durability will be increased, and a superior yield will be obtained. Thus, a reliable liquid discharge head can be obtained that provides fast responses and accurate discharge control.

Further features of the present invention will become apparent from the following description of exemplary embodiments with reference to the attached drawings.

DESCRIPTION OF THE EMBODIMENTS

First Embodiment

Figure 1:
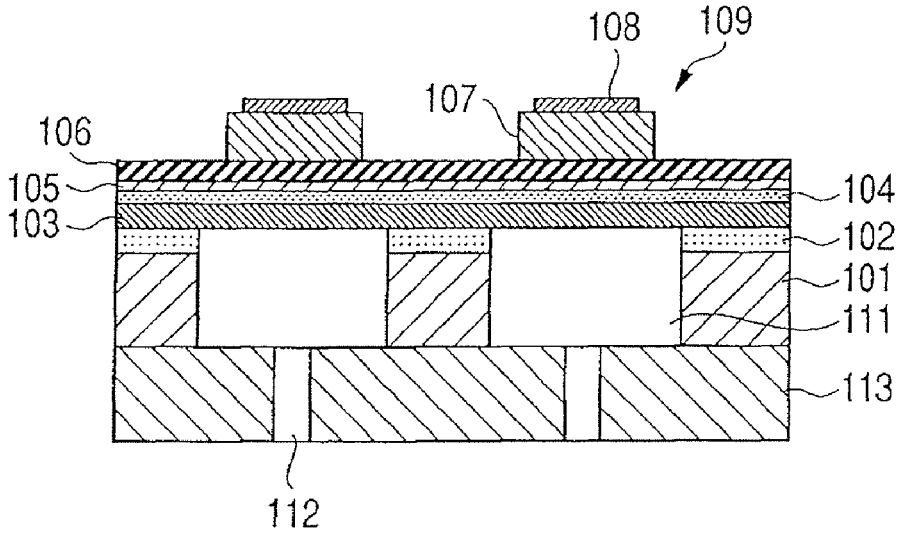
FIG. 1 is a cross sectional view of an example ink jet recording head according to a first embodiment of the present invention.

FIG. 1 is a schematic cross sectional view of an ink jet recording head according to a first embodiment of the invention. An Si wafer is employed as a substrate 101. And sequentially formed on the Si substrate 101 are an $SiO_2$ layer (a box layer) 102, an Si single crystal layer (an SOI layer) 103 that serves as a vibration plate and an $SiO_2$ layer 104, and a lower electrode 105, an insulating member layer (hereinafter also referred to as an insulating layer) 106, a piezoelectric layer 107 and an upper electrode 108. It should be noted that the lower electrode 105, the insulating layer 106, the piezoelectric layer 107 and the upper electrode 108 form a piezoelectric device 109.

A high electrical insulating, high temperature resistant film, such as $Al_2O_3$, AlN, $Si_3N_4$, $SiO_2$, MgO, $Ta_2O_5$, SiC, YSZ, $ZrO_2$, HfAlO or $HfO_2$, is employed for the insulating layer 106. Note that the dielectric constant of the insulating layer 106 should be higher than that of the piezoelectric layer 107, so that a strong, intense field will be applied to the piezoelectric layer 107 when laminated with the insulating layer 106. Also, since the insulating layer 106 is employed as an etching stop layer, an etching speed for the insulating layer 106 should be higher than the etching speed for the piezoelectric layer 107. In addition, while a thin insulating layer 106 is desirable because only a low voltage is to be applied, the film thickness of the insulating layer 106 should be sufficient to prevent damage should a strong field be applied. Specifically, a film thickness of 20 to 200 nm is appropriate, while a film thickness of 40 to 200 nm is even more appropriate.

A piezoelectric member having a perovskite structure containing lead zirconate titanate, relaxor or barium titanate as the primary element is employed as the piezoelectric layer 107.

Using etching, holes are formed in the substrate 101, under the vibration plate 103, for use as ink pressure chambers 111. Furthermore, ink orifices 112 that are consonant with the ink pressure chambers 111 are formed in an Si substrate 113 that is adhered to the substrate 101.

So long as the ink pressure chambers 111 are produced through etching and adhesion, and a discharge force can be effectively exerted on ink, the manufacturing method that can be used is not limited to the method described above.

The vibration plate 103 is formed over the ink pressure chambers 111 and on partition walls that separate the ink pressure chambers 111. The insulating layer 106 is also extended to a partition wall for an adjacent piezoelectric device.

Figure 2:
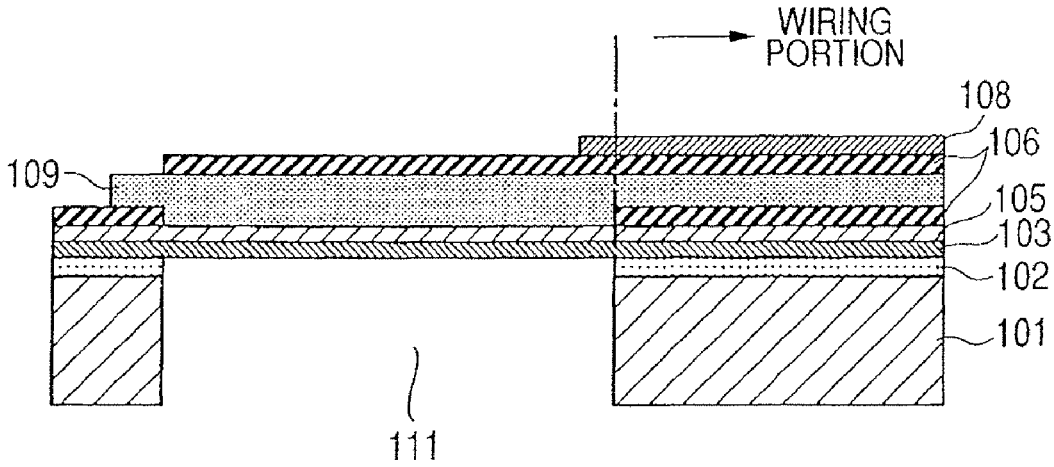
FIG. 2 is a cross sectional view of another example ink jet recording head according to the first embodiment.
Figure 3A:
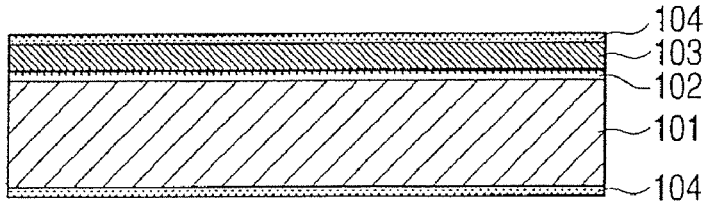
FIGS. 3A, 3B, 3C, 3D, 3E, 3F and 3G are diagrams illustrating the manufacturing process for ink jet recording heads according to the first embodiment.
Figure 3B:
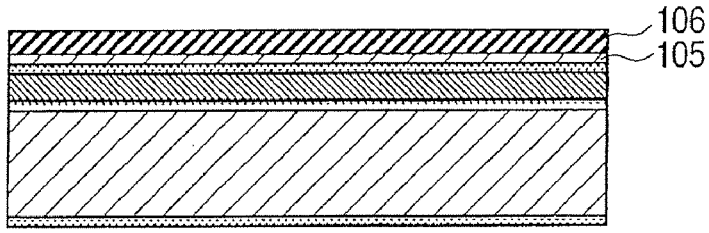
Figure 3C:
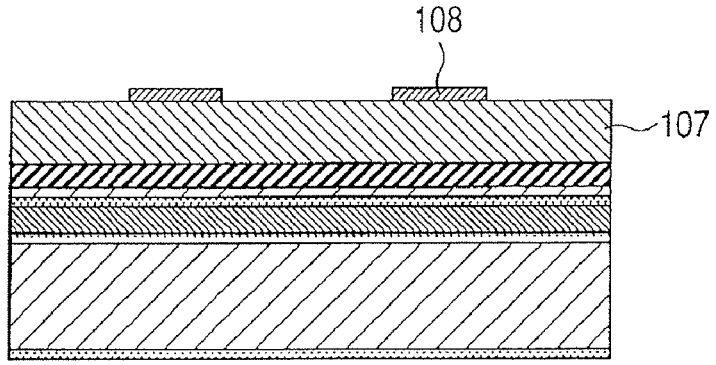
Figure 3D:
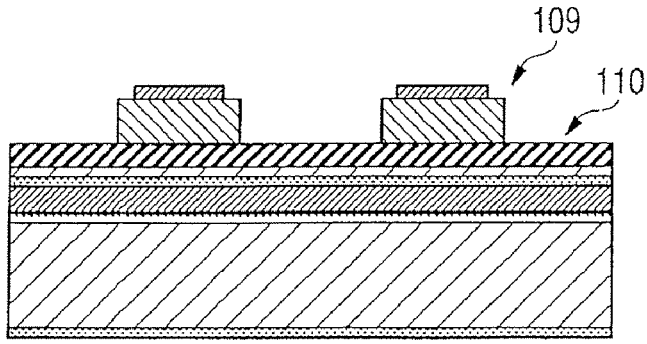
Figure 3E:
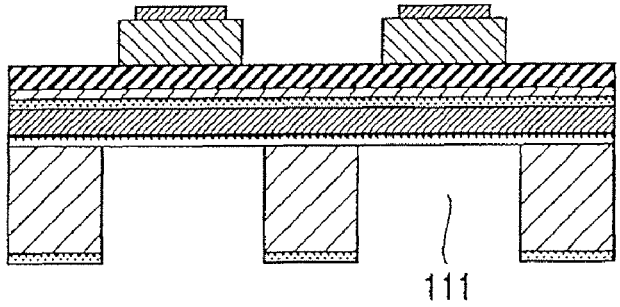
Figure 3F:
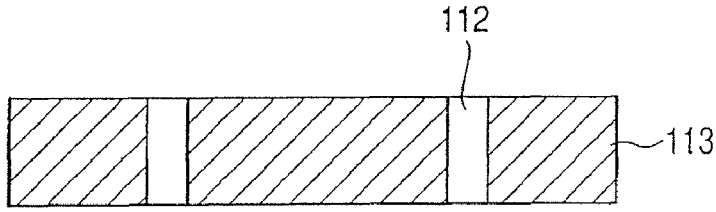
Figure 3G:
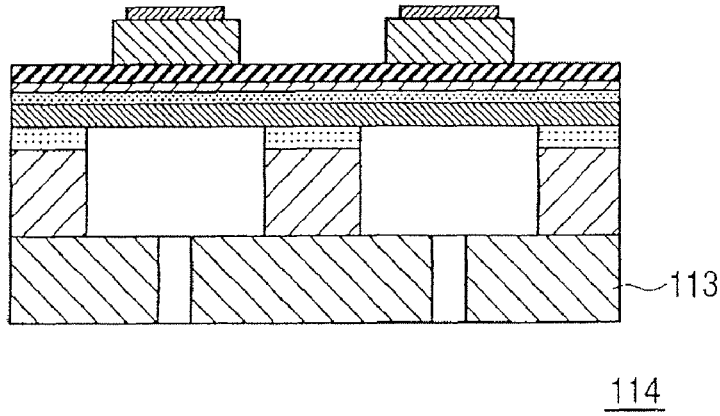

Further, as shown in FIG. 2, in addition to the insulating layer 106 formed on the lower electrode 105, an insulating layer 106 may be located under the upper electrode 108. FIG. 2 is a schematic, longitudinal cross sectional view of another ink jet recording head for this embodiment. In this example, the insulating layer 106 is also arranged under the upper electrode 108 in the wiring portion. With this arrangement, a short between the lower electrode 105 and the upper electrode 108 can be completely prevented, and the electrostatic capacity of the wiring portion can be remarkably reduced.

An example process for manufacturing the ink jet recording head according to the invention will now be described while referring to FIGS. 3A, 3B, 3C, 3D, 3E, 3F and 3G.

(A) Through thermal oxidization, the thermal oxide film (the $SiO_2$ layer) 104 is deposited on the silicon substrate 101 on which the SOI layer 103 is formed.

(B) The lower electrode 105, made of Pt/Ti, is deposited on the thermal oxide film 104 using sputtering, and further, the insulating film 106 is overlaid using the LPCVD method or the sputtering method. The thickness of the lower electrode 105 is about 300 to 1000 Å, and the thickness of the insulating layer 106 is about 1000 Å to 1 μm.

(C) A thin film containing lead zirconate titanate or barium titanate as the primary element is deposited on the insulating film 106 using sputtering or CVD, and the entire structure is sintered at 600° C. to 800° C. The thus obtained layer is used as a material layer for the piezoelectric layer 107. Then, a metal, such as Pt/Ti, is formed on the piezoelectric layer 107 and patterned, and in this manner, the upper electrodes 108 are formed.

(D) The piezoelectric layer 107 is etched to obtain the piezoelectric elements 109. At this time, the dry etching method is performed by using the insulating layer 106 as an etching stop layer. Since the insulating layer 106 is used as an etching stop layer, over-etching of the PT/Ti of the lower electrode 105 is prevented, and the attachment of Pt/Ti to the end face of the piezoelectric elements 109 does not occur.

In addition, the portion of the insulating layer 106 that is exposed during dry etching should be thinner than the portion of the insulating layer 106 located under the piezoelectric layer 107. This is because as the exposed portion of the insulating layer 106 becomes thinner, the constraint placed on the entire vibration plate 103 is reduced.

(E) After resist patterning has been completed, the ink pressure chambers 111 are formed below the piezoelectric elements 109 using the ICP (Inductively Coupled Plasma) etching method.

(F) Using this ICP method, the ink orifices 112 are formed in another silicon substrate, and the resultant substrate serves as an orifice plate 113.

(G) The orifice plate 113 is adhered to the above described substrate 101, and an ink discharge head 114 is completed.

Example 1-1

FIG. 1 is a schematic cross sectional view of an ink jet recording head for this example. A silicon SOI wafer was employed as a substrate 101. Then, an $SiO_2$ layer (a box layer) 102, 1 μm thick, an Si single crystal layer (SOI layer) 103, 5 μm thick, that serves as a vibration plate, and an $SiO_2$ layer 104, 3000 Å thick, were deposited on the Si substrate 101, which is 200 μm thick. Thereafter, a lower electrode 105, an insulating film 106, a piezoelectric layer 107 and upper electrodes 108 were sequentially formed to obtain a piezoelectric device 109. The lower electrode 105 was Pt/Ti=3000/300 Å, the insulating film 106 was $Al_2O_3$=4000 Å, the piezoelectric layer 107 was Pb(Zr, Ti)$O_3$ perovskite oxide (PZT)=2.7 μm, and the upper electrodes were Pt/Ti=3000/300 Å.

Using etching, holes were formed in the substrate 101 to form ink pressure chambers 111 under the vibration plate 103. Then, a silicon substrate 113, 200 μm thick, used for orifices, was adhered to the substrate 101, and ink orifices 112, each having a diameter of 40 μmσ, were formed in correspondence with the ink pressure chambers 111.

In this case, the width of an ink pressure chamber 111 was 100 μm, the depth was 3 mm, and the pitch between the devices 109 was 120 μm.

A printing test was conducted, using this head and water ink having a viscosity of 2 cp, at 30 kHz, with ink droplets of 3 pl that had a width of 12.5 mm. High quality printed matter could be obtained up to $2\times10^{10}$ times, before a portion was generated in which no ink was discharged.

Comparison Example 1-1

Figure 4:
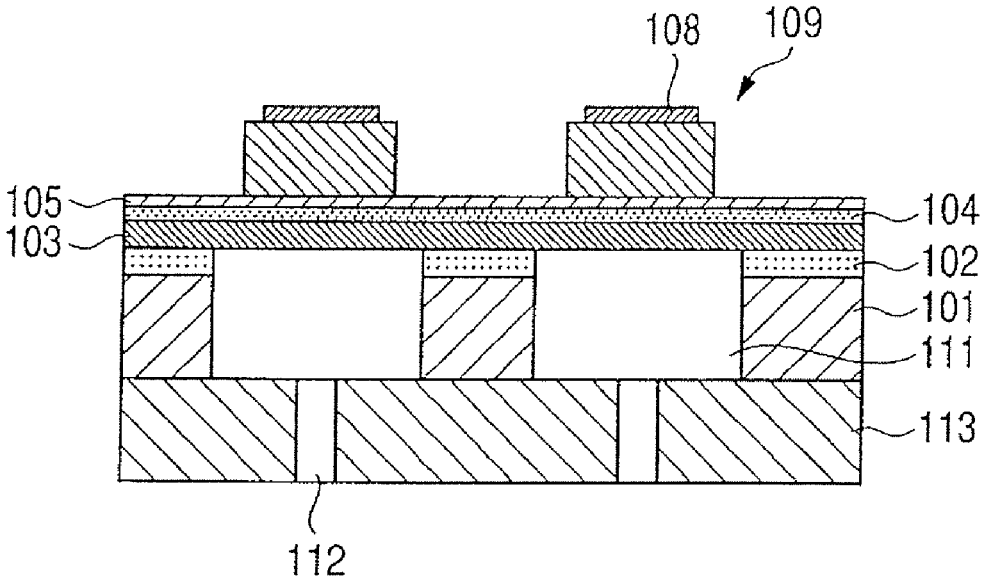
FIG. 4 is a cross sectional view of an ink jet recording head according to a comparison example.

FIG. 4 is a schematic cross sectional view of an ink jet recording head produced for comparison with that of the present invention. This ink jet recording head is the same as that in example 1-1, except that the insulating film 106 was not deposited. A printing test was conducted, using this head and water ink having a viscosity of 2 cp, at 30 KHz, with ink droplets of 3 pl that had a width of 12.5 mm. When printing was performed continuously, at $5\times10^{9}$ times a portion appeared in which no ink was discharged.

Example 1-2

Figure 5:
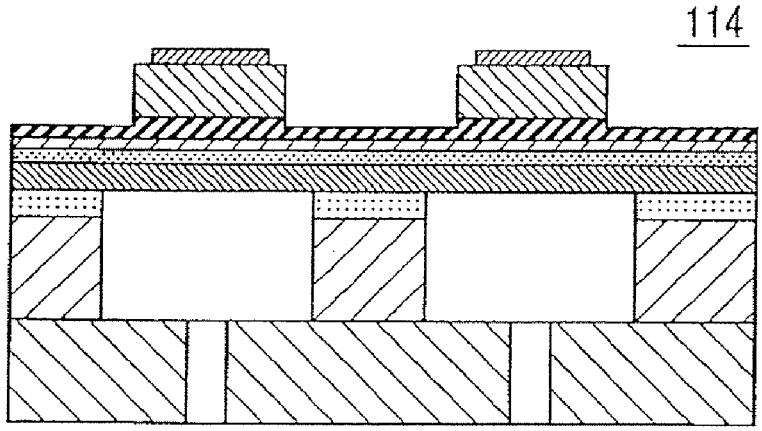
FIG. 5 is a cross sectional view of an ink jet recording head according to example 1-2 of the present invention.

As shown in FIG. 5, the insulating layer 106 was etched to reduce a film thickness 114, of a portion other than the piezoelectric layer 107, to 2000 Å. The remainder of the structure was the same as that in example 1-1. When deformation of an actuator was measured, a displacement that occurred upon application of a voltage of 30 V was greater by 8% than that in example 1-1. At a printing test, high quality printed matter was obtained up to $2\times10^{10}$ times without a portion being generated in which there was no discharge of ink.

Example 1-3

The process for manufacturing an ink jet recording head for this invention will be described while again referring to FIGS. 3A, 3B, 3C, 3D, 3E, 3F and 3G.

(A) Using thermal oxidization, a thermal oxide film (an $SiO_2$ layer) 104, 3000 Å thick, was deposited on a silicon substrate 101, 200 μm thick, on which were formed a box layer 102, 1 μm thick, and an SOI layer 103, 5 μm thick.

(B) Thereafter, a lower electrode of 105 Pt/Ti=3000/300 Å was overlaid using sputtering, and then an insulating film 106 of $Ta_2O_5$, which was 3000 Å thick, was deposited using sputtering.

(C) PZT, 3 μm thick, was deposited on the insulating film 106 using sputtering, and the entire structure was sintered at 700° C. for five hours. In this manner, a piezoelectric layer 107 was obtained. Furthermore, Pt/Ti—3000/300 Å was deposited on the piezoelectric layer 107 using sputtering and was patterned, and upper electrodes 108 were obtained.

(D) Dry etching was performed for the piezoelectric layer 107 employing $C_4F_8$ and $Cl_2$, and piezoelectric elements 109 were formed. During this process, a $Ta_2O_5$ layer served as an etching stop layer.

(E) After resist patterning was completed, $SF_6$ and $C_4F_8$ were alternatively introduced, and using the ICP (Inductively Coupled Plasma) etching method, Si was etched until the box layer was reached. As a result, ink pressure chambers 111 were obtained below the piezoelectric elements 109.

(F) Also using the ICP method, ink orifices 112, each having a diameter of 40 μm, were formed in another silicon substrate that was 150 μm thick, and the resultant silicon substrate was employed as an orifice plate 113.

(G) Au/Ti=1000/300 Å was deposited on the orifice plate 113 using sputtering, and thereafter, the two substrates 101 and 113 were adhered to each other by a vacuum bonding machine under a pressure of 3 MPa at 300° C. As a result, an ink jet recording head was completed.

The sizes of the individual portions of the head were the same as those for example 1-1. A printing test was conducted, using this head and water ink having a viscosity of 2 cp, at 30 kHz, with ink droplets of 3 pl that had a width of 12.5 mm. High quality printed matter could be obtained up to $3\times10^{10}$ times, before a portion was generated in which no ink was discharged.

According to the first embodiment, the insulating layer deposited between the piezoelectric film and the lower electrode prevented a fault caused by electricity leaking from the end face of a piezoelectric device, which was formed after the piezoelectric device was etched. Furthermore, since the insulating layer having a different etching speed from that of the piezoelectric material was formed on the lower electrode, over-etching of the lower electrode could be avoided, and the piezoelectric device could be protected from being contaminated by the dispersing of the material of the low electrode.

Second Embodiment

Figure 6A:
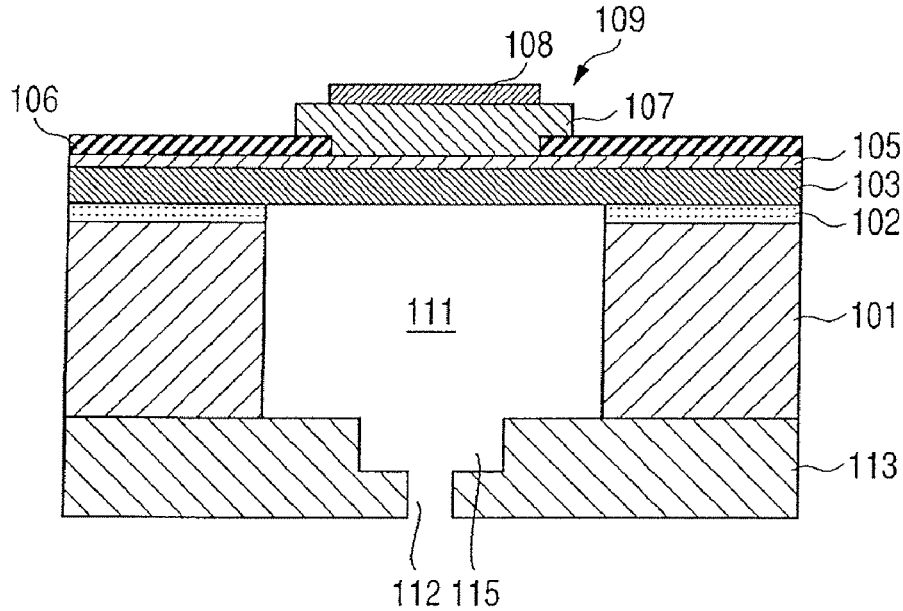
FIG. 6A is a cross sectional view of an ink jet recording head according to a second embodiment of the present invention.
Figure 6B:
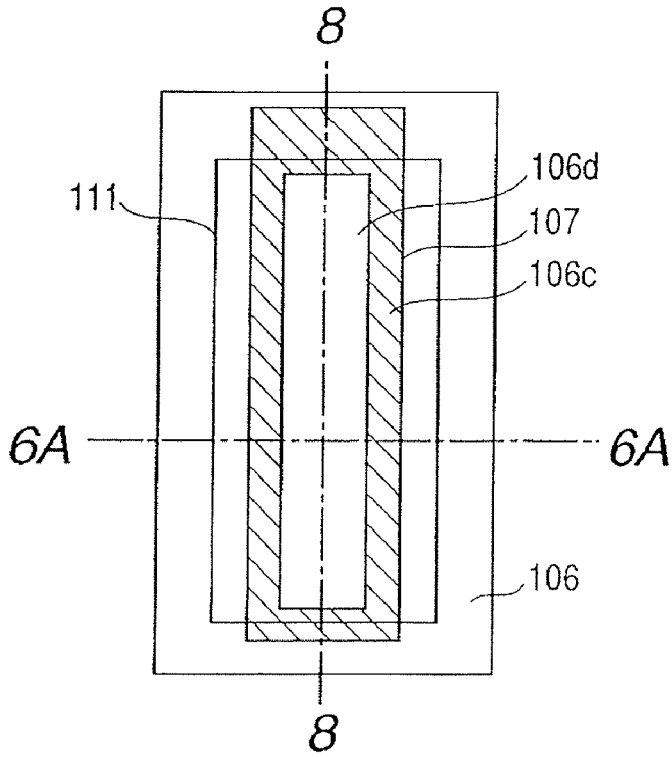
FIG. 6B is a top view of the ink jet recording head of the second embodiment.

FIG. 6A is a schematic cross sectional view, taken along 6A-6A in FIG. 6B, of an ink jet recording head according to a second embodiment of the invention. An Si wafer is employed as a substrate. And an $SiO_2$ layer (a box layer) 102 and an Si single crystal layer (an SOI layer) 103, which serves as a vibration plate, and a lower electrode 105, an insulating layer 106, a piezoelectric layer 107 and an upper electrode 108 are sequentially formed on the Si substrate 101. It should be noted that the lower electrode 105, the insulating layer 106, the piezoelectric layer 107 and the upper electrode 108 form a piezoelectric device 109.

The insulating layer 106 is the same as that for the first embodiment

A liquid discharge head according to the present invention includes: plural pressure chambers for applying pressure to liquid, which communicate with liquid discharge openings for discharging liquid respectively; and plural piezoelectric elements, arranged corresponding to the plural pressure chambers respectively, include, lower electrodes, piezoelectric layers and upper electrodes layered in order from the pressure chambers, the lower electrodes being extended to areas corresponding to areas between the plural pressure chambers wherein an insulating layer is provided so as to cover at least all the lower electrodes located in the areas corresponding to areas between the plural pressure chambers. Piezoelectric member having a perovskite structure that contains, as the primary element, lead zirconate titanate, relaxor or barium titanate is employed as the piezoelectric layer 107.

Using etching, holes are formed in the substrate 101 to form ink pressure chambers 111 under the vibration plate 103. Furthermore, an orifice plate 113, in which ink communication ports 115 and ink orifices 112 are formed, is adhered to the substrate 101. As a result, the ink jet recording head is completed. An SUS substrate or an Si substrate can be employed as the orifice plate 113.

So long as a discharge force can be effectively exerted on ink, the structure, the material and the manufacturing method for the ink pressure chambers are not limited to those described above. Further, for an electrode material, an insulating film and a piezoelectric member, an appropriate formation method can also be employed.

The vibration plate 103 is formed on partition walls that separate the ink pressure chambers 111, and the insulating layer 106 is also formed on the partition walls for adjacent piezoelectric device.

FIG. 6B is a schematic top view of the piezoelectric device portion of the ink jet recording head of this embodiment. The piezoelectric device portion includes the lower electrode 105, the piezoelectric layer 107 and the upper electrode 108 in the portion corresponding to the ink pressure chamber 111. The width of the upper electrode 108 is smaller than the width of the piezoelectric layer 107, and the width of the lower electrode 105 is greater than the width of the piezoelectric layer 107. The insulating layer 106 is located between the piezoelectric layer 107 and the lower electrode 105, and there are an under-piezoelectric-member insulating layer 106*c*, which is under the piezoelectric layer 107, and a non-film formation area 106*d*, which is used to establish electric contact between the lower electrode 105 and the piezoelectric layer 107. In addition, as shown in FIGS. 6A and 6B, the insulating layer 106 is also formed along the outer edge of the piezoelectric device portion to cover the lower electrode 105.

Figure 7:
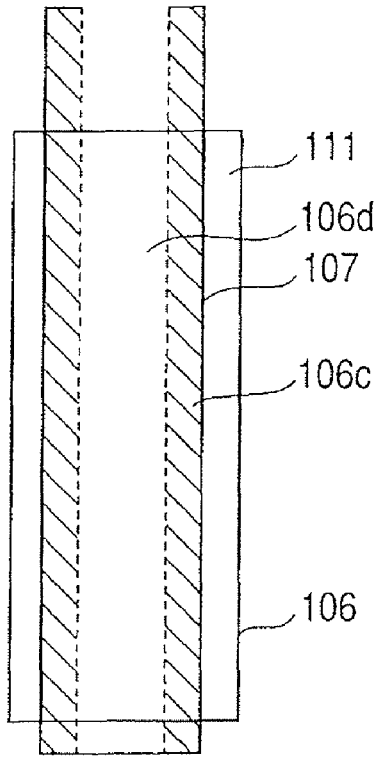
FIG. 7 is a top view of another example ink jet recording head according to the second embodiment.

Further, as shown in the structure in FIG. 7, the longitudinal outer edges of a piezoelectric device portion may be covered with an insulating film, while the shorter sides may not be covered with an insulating film. In this case, compared with the structure shown in FIG. 6B, the lower electrode 105 is exposed in the short side areas of the piezoelectric device portion. Therefore, the probability a short will occur between the upper and lower electrodes is slightly increased. However, since the constraint imposed on the piezoelectric device portion by the insulating layer 106 is relaxed, a displacement generated upon the application of the same voltage is improved.

According to either structure in FIG. 6B or 7, because of a lead-out electrode, the piezoelectric layer 107 is extended to a portion other than the piezoelectric device portion, and at least one end of the piezoelectric layer 107 is extended across one end of the ink pressure chamber 111 outside the ink pressure chamber 111 (not shown). Since the insulating layer 106 is also formed between the lower electrode 105 and the piezoelectric layer 107, present in an area other than in the piezoelectric device portion, the electrostatic capacity can be reduced, compared with when only the insulating layer 106 or the piezoelectric layer 107 is present between the electrodes. Therefore, fast driving is enabled. And furthermore, in this embodiment, since the non-film formation area 106*d* is provided, the lower electrode 105 is electrically connected to the piezoelectric layer 107. While an electric field can be more appropriately applied to the piezoelectric layer for the arrangement in which the electrode and the piezoelectric layer are present through the insulating layer, a superior function for the piezoelectric device is obtained for the arrangement of the embodiment in which the lower electrode 105 and the piezoelectric layer 107 are electrically connected.

Figure 8:
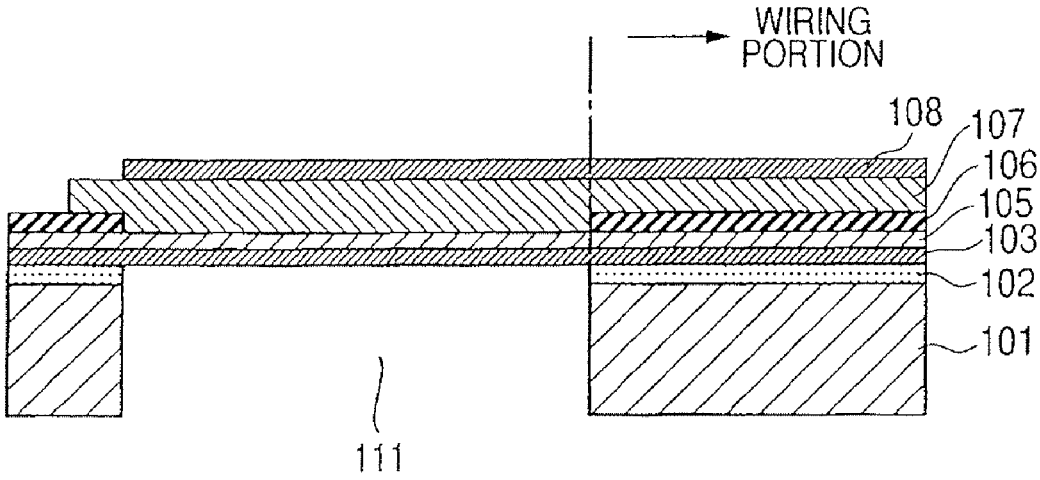
FIG. 8 is a longitudinal cross sectional view of the ink jet recording head according to the second embodiment.
Figure 9A:
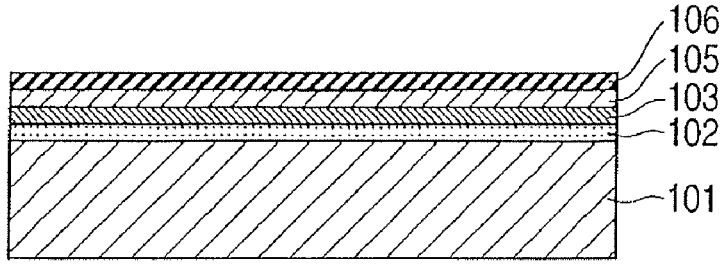
FIGS. 9A, 9B, 9C, 9D, 9E, 9F, 9G and 9H are diagrams illustrating a method for manufacturing the ink jet recording head according to the second embodiment.
Figure 9B:
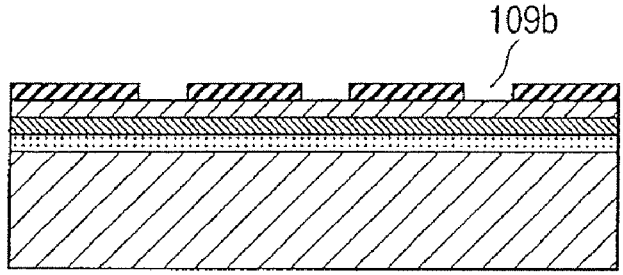
Figure 9C:
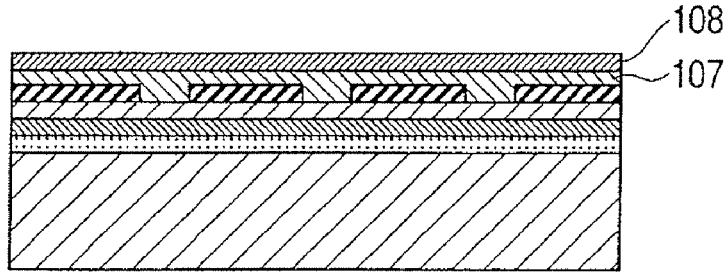
Figure 9D:
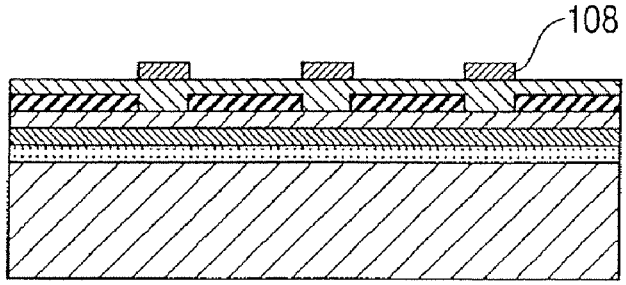
Figure 9E:
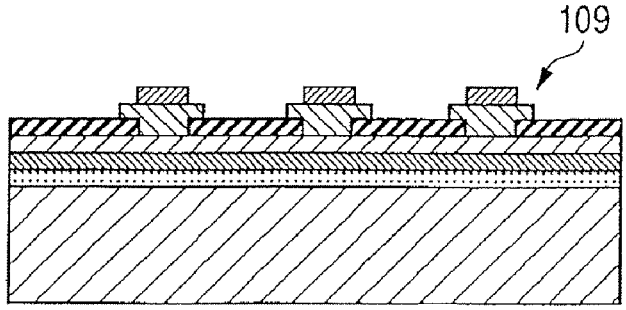
Figure 9F:
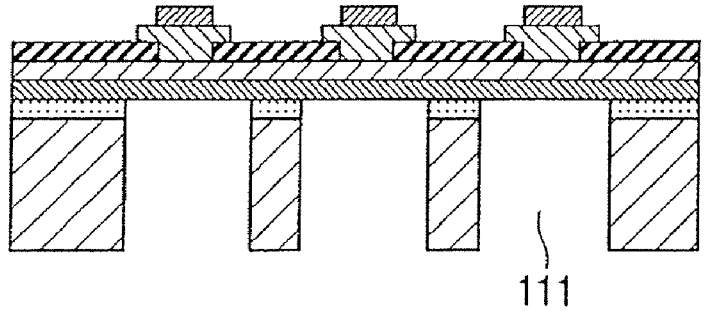
Figure 9G:
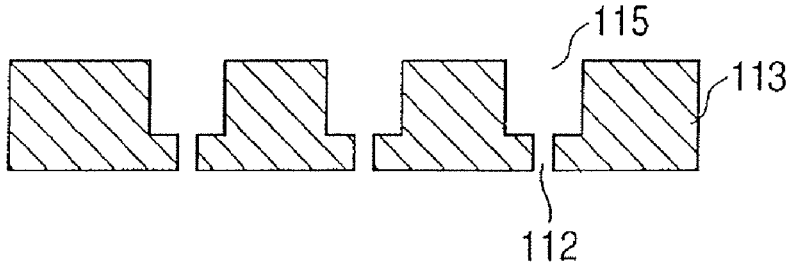
Figure 9H:
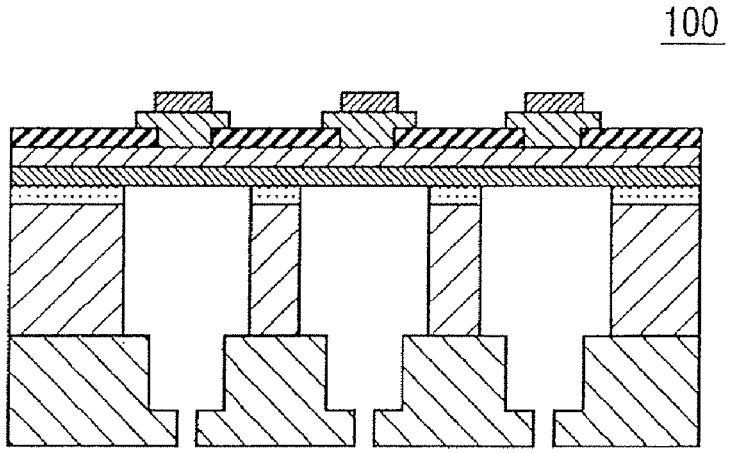

FIG. 8 is a longitudinal cross sectional view of the ink jet recording head of this embodiment taken along 8-8 in FIG. 6B. In FIG. 8, a component such as the orifice plate 113, is not shown. As illustrated in FIG. 8, the portion, other than that above the ink pressure chambers 111, where the piezoelectric layer 107 and the lower electrode 105 are formed is provided simply for wiring. In the wiring portion, the structure formed by the upper electrode 108, the piezoelectric layer 107 and the lower electrode 105 serves as a capacitor, and generates an unnecessary electrostatic capacity. Therefore, the lower electrode 105 and the piezoelectric layer 107 in this portion should be blocked completely by the insulating layer 106. When a material having a dielectric constant lower than that of the piezoelectric layer 107 is selected for the insulating layer 106, the electrostatic capacity of this portion can be reduced, and a faster response enabled.

An example process for the manufacture of the ink jet recording head according to this invention will be described, while referring to FIGS. 9A, 9B, 9C, 9D, 9E, 9F, 9G and 9H.

(A) The lower electrode, of Pt/Ti, is formed on the silicon substrate 101 on which the vibration plate layer 103, which is an SOI layer, and the oxide film 102, which is a box layer, are deposited. In addition, the insulating layer 106 is overlaid. $Al_2O_3$, AlN, $Si_3N_4$, $SiO_2$, MgO, $Ta_2O_5$ or SiC can be applied for the insulating layer 106.

(B) The non-film formation areas 106*d* are formed by patterning the insulating layer 106.

(C) A thin film that contains lead zirconate titanate or barium titanate as the primary element is deposited on the patterned insulating layer 106, and the entire structure is sintered at 600° C. to 800° C. to obtain the piezoelectric layer 107. A metallic material such as Pt/Ti, for the upper electrodes 108, is deposited on the piezoelectric layer 107.

(D) The upper electrodes 108 are obtained by patterning.

(E) Device separation is performed by etching the piezoelectric layer 107, and the piezoelectric elements 109 are obtained. For this process, the dry etching method is employed, using the insulating layer 106 as an etching stop layer. When the insulating layer 106 is employed as an etching stop layer, the occurrence of a phenomenon where Pt/Ti, of the lower electrode 105, is sputtered and is attached to the end face of the piezoelectric elements can be prevented.

The portions of the insulating layer 106 that are exposed by dry etching should be thinner than the insulating layer 106*c* located under the piezoelectric layer 107. This is because, as the exposed portions of the insulating layer become thinner, the constraint imposed on the entire vibration plate is relaxed.

(F) After resist patterning has been completed, the silicon substrate 101 is etched from the side opposite the face at which the piezoelectric elements 109 are formed. In this manner, the ink pressure chambers 111 are formed below the piezoelectric elements 109.

(G) The ink communication portions 115 and the ink orifices 112 are formed in another silicon substrate, and the resultant silicon substrate is employed as the orifice plate 113.

(H) The silicon substrate 101 and the orifice plate 113 are adhered to each other, and the ink jet recording head 114 is completed.

Example 2-1

FIGS. 6A and 6B are schematic cross sectional views of an ink jet recording head as an example according to the invention. A silicon SOI wafer was employed as a substrate. And an $SiO_2$ layer (a box layer) 102, 1 μm thick, and an Si single crystal layer (an SOI layer) 103, 5 μm thick, which serves as a vibration plate, were formed on an Si substrate 101, 200 μm thick. An $SiO_2$ layer, 300 nm thick, was deposited as a thermal oxide film on the SOI layer 103 (not shown). Then, a lower electrode 105 made of Pt/Ti=300/30 nm and an insulating layer 106 made of $SiO_2$, 300 nm thick, were overlaid, and the insulating layer 106 was partially removed by etching to obtain non-film formation areas 106*d*. Thereafter, a piezoelectric layer 107 made of lead zirconate titanate (PZT), 2.7 μm thick, and a layer for upper electrodes 108 made of Pt/Ti=300/30 nm were sequentially formed, and then the piezoelectric layer 107 and the layer for the upper electrodes 108 were etched to obtain piezoelectric elements 109. The thicknesses of the vibration plate, the PZT layer, the electrodes and the insulating film used in this example are merely examples, and can be changed, as needed. When $SiO_2$ is employed for the insulating layer 106, a thickness of 10 nm to 1000 nm is appropriate, while taking into account the displacement obstruction and the function of an etching stop layer.

In the substrate 101, holes were formed using etching in order to prepare ink pressure chambers 111. Further, the substrate 101 was adhered to a silicon substrate 113, used for orifices of 200 μm, in which ink communication portions 115 and ink orifices 112 were formed. In this manner, an ink jet recording head was completed. The width of the ink pressure chambers 111 was 100 μm, the depth was 3 mm, and the pitch between the piezoelectric elements 109 was 220 μm.

A printing test was conducted, using this head and water ink having a viscosity of 2 cp, at 30 kHz, with ink droplets of 3 pl that had a width of 12.5 mm. High quality printed matter could be obtained up to $2\times10^{10}$ times, before a portion appeared in which no ink was discharged.

Comparison Example 2-1

The same process as in example 2-1 was performed to manufacture piezoelectric elements, except that an insulating layer 106 was not formed. A printing test was conducted, using this ink jet recording head and water ink having a viscosity of 2 cp, at 30 kHz, with ink droplets of 3 pl that had a width of 12.5 mm. As a result, when printing had been performed $5\times10^{9}$ times, a short occurred between the upper and lower electrodes, and a portion appeared in which no ink was discharged.

Example 2-2

Figure 10:
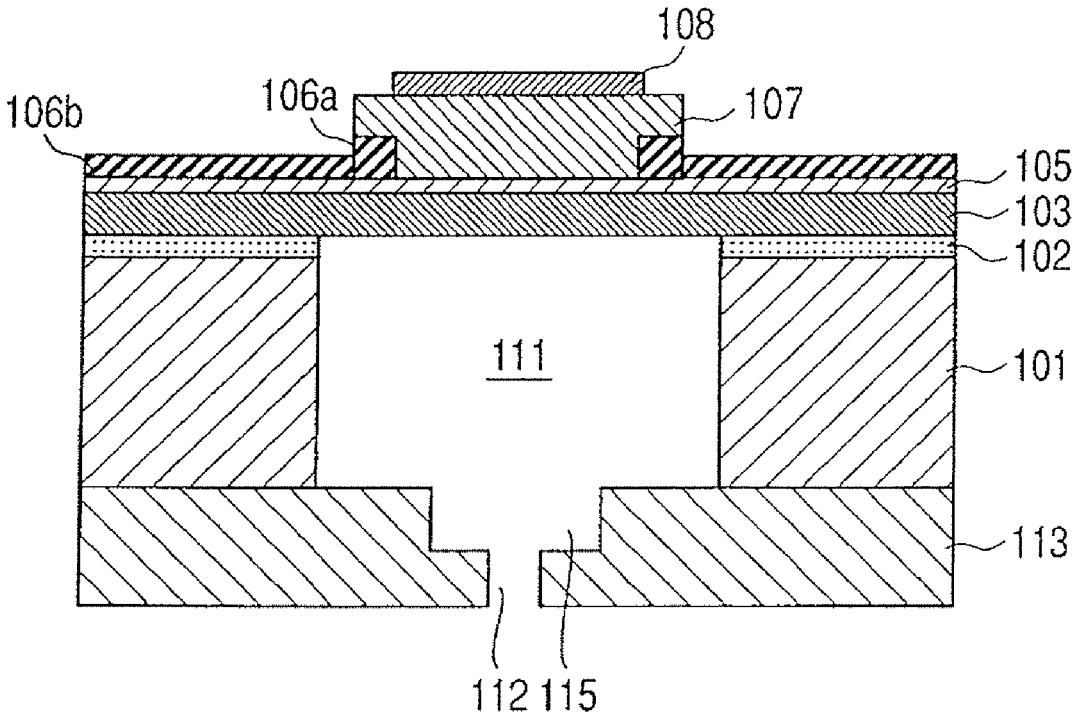
FIG. 10 is a cross sectional view of an ink jet recording head according to example 2-2 of the invention.

As shown in FIG. 10, by over-etching an insulating layer 106, the thickness of a portion of an insulating layer 106*b* other than the portion under a piezoelectric layer 107 was reduced to 200 nm. The other structure is the same as in example 2-1. When deformation of a piezoelectric device was measured, a displacement that occurred upon application of a voltage of 30 V was greater by 8% than that in example 2-1. During a printing test, high quality printed matter was obtained up to $2\times10^{10}$ times, before a portion occurred in which there was no ink was discharged.

Example 2-3

A method for manufacturing an ink jet recording head according to the present invention will be described, while referring to FIGS. 9A, 9B, 9C, 9D, 9E, 9F, 9G and 9H.

(A) A lower electrode 105, made of Pt/Ti=300/30 nm, was deposited, using sputtering, on a silicon substrate 101 of 200 μm on which a box layer 102, 1 μm thick, which serves as an $SiO_2$ layer, and an SOI layer 103, 5 μm thick, were deposited. Furthermore, an insulating layer 106 made of $Ta_2O_5$, 300 nm thick, was overlaid using sputtering.

(B) Then, the insulating layer 106 was partially removed, using etching, to obtain non-film formation areas 106*d*.

(C) PZT, 3 μm thick, was deposited, using sputtering, on the insulating layer 106 where the non-film formation areas 106*d* were formed, and the entire structure was sintered at 700° C. for five hours under an oxygen atmosphere. As a result, a piezoelectric layer 107 was formed. In addition, using sputtering, Pt/Ti=300/30 nm thick was deposited as an electrode layer on the piezoelectric layer 107.

(D) The Pt/Ti layer=300/30 nm was patterned to form upper electrodes 108.

(E) Dry etching was performed for the piezoelectric layer 107 using an etching gas that contained $C_4F_8$ and $Cl_2$, and piezoelectric elements 109 were obtained. At this time, the $Ta_2O_5$ layer served as an etching stop layer.

(F) After resist pattering was completed, while the box layer 102 was used as a stop etching layer, etching was performed from the face opposite the face at which the piezoelectric elements 109 were formed. A method that enables vertical deep etching is an appropriate etching method. The etching in this example was performed using a so-called Bosch process that employs, as a plasma source, an ICP (Inductively Coupled Plasma) source that can generate a high density plasma, and uses $SF_6$ and $C_4F_8$ as an etching gas. The etching was performed until the box layer 102 was exposed, and the exposed portion of the box layer 102 was removed using buffered hydrofluoric acid. In this manner, ink pressure chambers 111 were obtained.

(G) Also using the ICP method, ink communication portions 115 and ink orifices 112 having a diameter of 30 μm were formed in another silicon substrate 150 μm thick, and the resultant substrate was employed as an orifice plate 113.

(H) Au/Ti=100/30 nm was deposited on the orifice plate 113 using sputtering, and the orifice plate 113 and the silicon substrate 101 were adhered to each other by a vacuum bonding machine under a 3 MPa pressure at 300° C. As a result, an ink jet recording head was completed.

The sizes of the individual portions of the head were the same as those in example 2-1. A printing test was conducted, using this head and water ink having a viscosity of 2 cp, at 30 kHz, with ink droplets of 3 pl that had a width of 12.5 mm. High quality printed matter could be obtained up to $3\times10^{10}$ times, before a portion occurred in which no ink was discharged.

According to the above described second embodiment, since the insulating layer is formed on the lower electrode so that part of the insulating layer extends below the piezoelectric layer, the lower electrode will not be exposed and sputtered during the etching process, and contamination of the device portion can be prevented by dispersing the material of the lower electrode. Furthermore, since the insulating member having a lower dielectric constant than the piezoelectric member is located between the piezoelectric member and the lower electrode, the electrostatic capacity of the piezoelectric device can be reduced, and quicker response to a drive wave is enabled. Therefore accurate discharge control can be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-244150, filed Sep. 8, 2006, which is hereby incorporated by reference herein in its entirety.

What is claimed is:

1. A liquid discharge head comprising:

plural pressure chambers for applying pressure to liquid, which respectively communicate with liquid discharge openings for discharging liquid; and plural piezoelectric elements arranged respectively corresponding to the plural pressure chambers; and which respectively include lower electrodes, piezoelectric layers and upper electrodes layered in order from the pressure chambers, the lower electrodes being extended to areas corresponding to areas between the plural pressure chambers, wherein an insulating layer is provided so as to cover at least all the lower electrodes located in the areas corresponding to areas between the plural pressure chambers, and wherein a portion of the insulating layer, other than a portion corresponding to the piezoelectric layer, is thinner than the portion corresponding to the piezoelectric layer.

2. A liquid discharge head according to claim 1, wherein at least one end of the piezoelectric layers extends outside areas corresponding to the pressure chambers;

wherein a width of the piezoelectric layer is greater than the upper electrodes and smaller than the lower electrodes; and wherein the insulating layer is at least formed along longitudinal outer edges of the piezoelectric elements, and portions where the insulating layer is not deposited are formed in order to electrically contact the lower electrodes and the piezoelectric layers.

3. A liquid discharge head according to claim 2, wherein the insulating layer is at least formed along the entire edges of the piezoelectric elements.

4. A liquid discharge head according to claim 1, wherein the insulating layer is thinner than the piezoelectric layers.

5. A manufacturing method, for a liquid discharge head that includes plural pressure chambers for applying pressure to liquid, which respectively communicate with liquid discharge openings for discharging liquid, and plural piezoelectric elements, arranged respectively corresponding to the plural pressure chambers, which respectively include lower electrodes, piezoelectric layers and upper electrodes layered in order from the pressure chambers, the lower electrodes being extended to areas corresponding to areas between the plural pressure chambers, and wherein an insulating layer is provided so as to cover at least all the lower electrodes located in the areas corresponding to areas between the plural pressure chambers, said method comprising the steps of:

depositing an insulating layer on the lower electrodes;

forming a material layer, for the piezoelectric layers, on the insulating layer; and etching portions of the material layer, for the piezoelectric layers, to expose the insulating layer between the plural piezoelectric elements.

6. A manufacturing method according to claim 5, wherein a dry etching method is employed for etching, and the lower electrodes contain Pt.

* * * * *